United States Patent [19]

Garcia

[11] Patent Number: 4,712,803

[45] Date of Patent: Dec. 15, 1987

[54] COLLAPSIBLE SAILBOARD DOLLY

[76] Inventor: Joseph T. Garcia, 20336 Anza Ave., #35, Torrance, Calif. 90503

[21] Appl. No.: 894,620

[22] Filed: Aug. 8, 1986

[51] Int. Cl.[4] ..... B62B 1/12

[52] U.S. Cl. ..... 280/47.13 B; 114/344; 280/40; 280/42; 280/652; 280/47.33; 441/74

[58] Field of Search ..... 280/47.13 B, 47.13 R, 280/47.33, 42, 40, 657, 651, 652; 114/39.2, 344; 441/74

[56] References Cited

U.S. PATENT DOCUMENTS

| | | | |
|---|---|---|---|
| 2,778,515 | 1/1957 | Hanson | 280/47.27 |
| 3,734,528 | 5/1973 | Echols, Jr. | 280/42 |
| 4,327,933 | 5/1982 | Tuggle | 280/47.13 B |
| 4,440,409 | 4/1984 | Margison | 280/47.13 B |
| 4,515,383 | 5/1985 | Minnebraker | 280/42 |
| 4,521,030 | 6/1985 | Vance | 280/42 |
| 4,544,172 | 10/1985 | Poulouin | 280/47.13 B |
| 4,602,802 | 7/1986 | Morgan | 280/47.13 B |

*Primary Examiner*—David M. Mitchell
*Assistant Examiner*—Eric D. Culbreth
*Attorney, Agent, or Firm*—Monty Koslover

[57] ABSTRACT

A dolly for carrying sailboards has a frame made of lightweight tubing, and has two pneumatic tired wheels mounted independently on opposite sides of the frame. The frame utilizes a telescoping tube arrangement to enable it to provide rigid support for the sailboard, and to allow it to be collapsed into a small, relatively flat package for storage. The dolly is designed particularly, so as to be able to easily transport sailboards across soft sandy beaches, without sinking in the sand, as well as on hard paved surfaces.

2 Claims, 7 Drawing Figures

COLLAPSIBLE SAILBOARD DOLLY

BACKGROUND OF THE INVENTION

1. Field of the Invention

This invention relates to wheeled transporters for sailboards and surfboards, and particularly to collapsible transporters, intended for compact storage when not in use.

2. Description of the Prior Art

Various wheeled devices have been available for some time, for use in transporting sailboards or surfboards on land, across beaches and to the water's edge for launching. These devices typically have two wheels with an axle mounted between the wheels, or may have a single wheel plus framework for supporting the board. For example, the arrangement used in U.S. Pat. No. 4,544,172 by Poulouin utilizes two wheels mounted at either end of an axle, and a fixed rigid frame on which to mount the sailboard. The wheels are relatively small and are not pneumatic, which is probably adequate on a hard paved surface, but could be troublesome on the soft sand found on many beaches. The device is not collapsible. Similarly, single wheel devices such as that used in U.S. Pat. No. 4,440,409 by Margison, require a very large 'balloon' tire in order to ensure that the weight of the sailboard or boat does not cause the wheel to sink in the sand while it is being transported.

Generally, a survey of the prior art including the many dollies advertised in the surfer magazines, reveals that those devices adequate for the task are either heavy, expensive, non-collapsible or large. Thus, there exists a need for a collapsible, light, inexpensive wheeled dolly, which is capable of being collapsed into a very small package for stowing in a car trunk, and whose construction is at once light, strong, simple to fabricate and durable in use.

SUMMARY OF THE INVENTION

The invention comprises a collapsible frame constructed of light tubing, and two wheel assemblies. Each wheel assembly is separately attached to a portion of the frame, there being no communicating axle between the two wheels. The frame is comprised of two parallelogram tubing assemblies, joined by two telescoping support assemblies on each side, and a stand. The parallelogram tubing assemblies are fastened to each other at a center point on two sides, so that they can swivel in scissors-like fashion to open or close. The wheels are of a light plastic material and utilize 'balloon' type pneumatic tires. Provision is made for attaching a carrying bag to the frame for transportation of personal equipment. The sailboard or surfboard lies on top of the frame and is secured by straps. The overall weight of the device is approximately 15 pounds.

Accordingly, it is a principal object of this invention to provide a wheeled transporter which is collapsible and light in weight, and which is suitable for use with sailboards and surfboards when transporting them across sandy beaches as well as on hard paved surfaces.

Another object is to provide a structure which is strong, simple in fabrication and durable in use.

It is another object to provide for attaching a carrying bag for carrying personal equipment. It is yet another objective to provide a device that is small enough when collapsed, for stowing in the trunk of a car.

Further objects and advantages of the invention will become apparent from the study of the following portion of the specification, the claims and the attached drawings.

DESCRIPTION OF THE PREFERRED EMBODIMENTS

Figure 1:
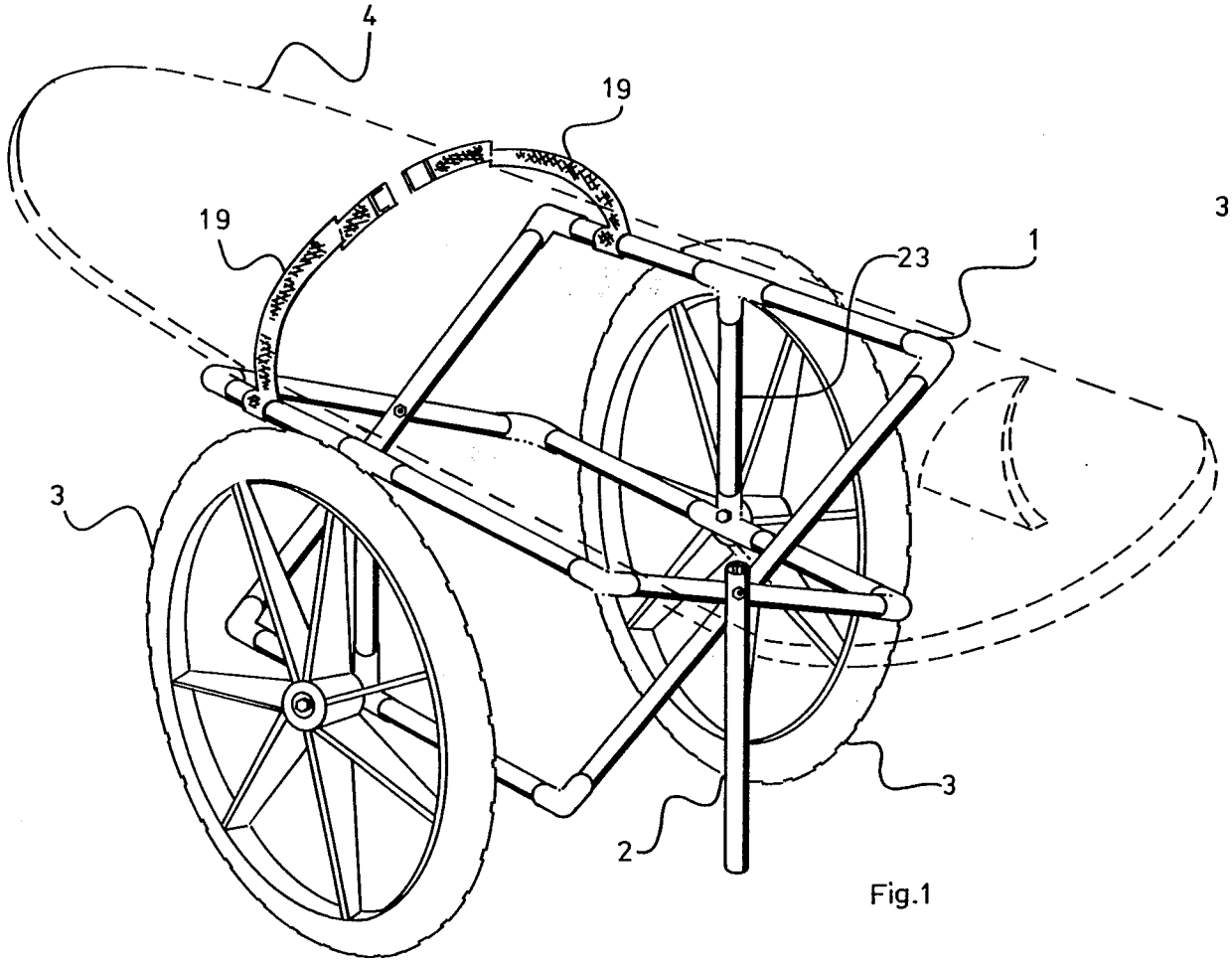
FIG. 1 is a perspective view of the collapsible sailboard dolly, showing the present invention and a dashed-in sailboard or surfboard attached by straps to the dolly.

Referring particularly to the drawings, there is shown in FIG. 1, the assembled, fully open, sailboard dolly, ready for the attachment and transportation of a sailboard or surfboard 4. The dolly comprises a frame 1, a stand 2, and two wheel assemblies 3 attached to the frame 1. Straps 19 are attached to the frame 1 for use in tieing the sailboard 4 securely to the frame 1. The frame 1 members are preferably plastic 'PVC' tubing, joined by plastic 'PVC' tee joints and elbows. The wheel assembly 3 frame and hub are similarly fabricated from a plastic material, with a steel axle bolt. The sailboard of surfboard 4 is supported by the dolly near the board's edges, which is the recommended method of carrying the board and minimizing any damage to it during transportation.

Figure 2:
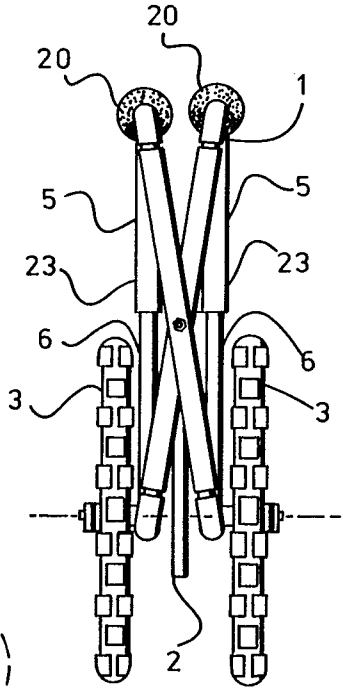
FIG. 2 is an end elevation view of the dolly in collapsed position, showing particularly the action of the telescoping support assemblies.

Referring now to FIG. 2, an end elevation view of the dolly is shown in the collapsed or folded position. The two telescoping support assemblies 23, are each made up of tube holder 5, slide rod 6 and end tees, and are shown in fully extended position. Also shown in this view are foam pads 20, four or more of which may be attached to the top bars of frame 1 to serve as a buffer between the sailboard surface and the frame, preventing marring of the sailboard surface.

Figure 4:
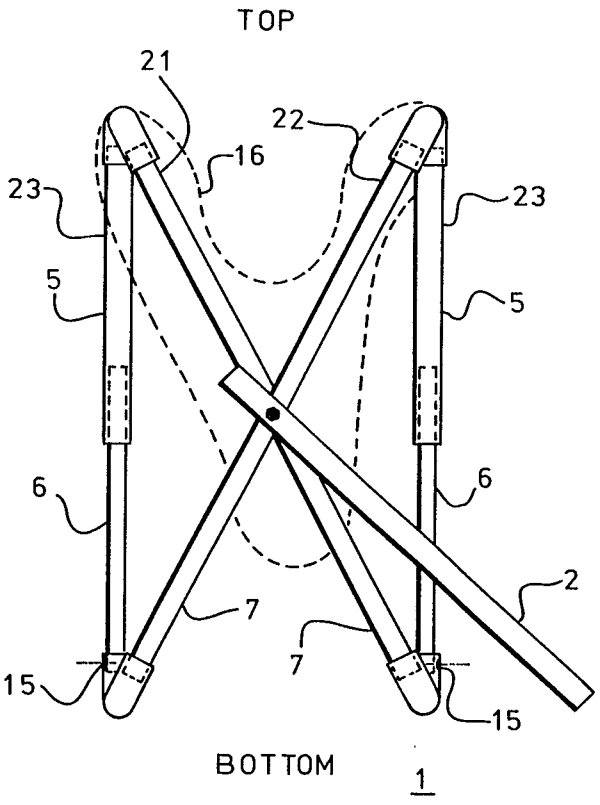
FIGS. 3 and 4 are respectively, a side elevation view and an end elevation view of the partially collapsed frame, showing also provision for attachment of a carrying bag.
Figure 3:
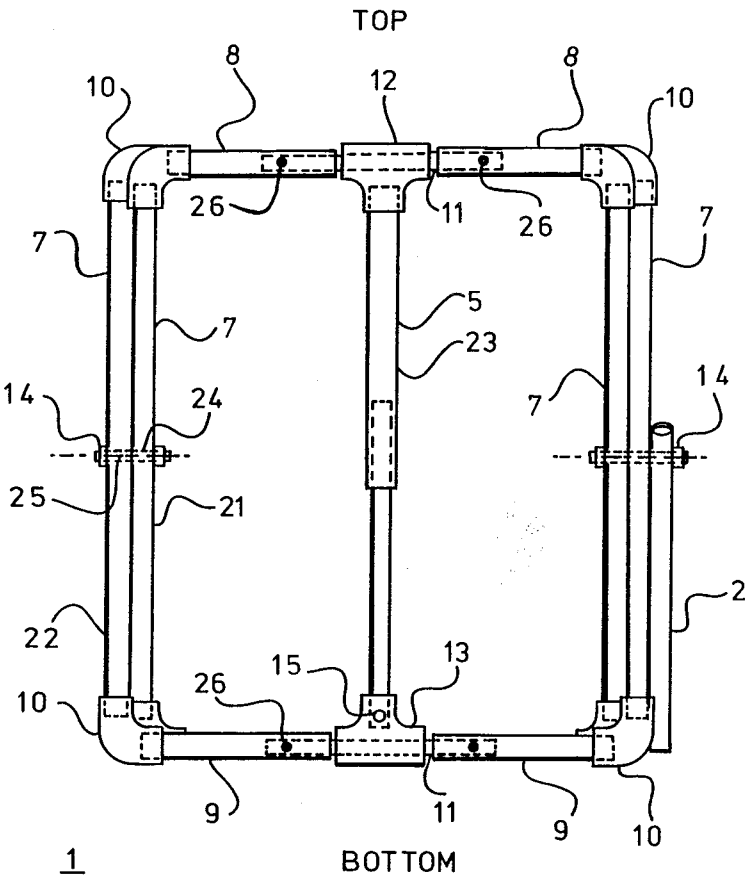

Referring specifically to FIGS. 3 and 4, there are shown two views of frame 1 in the partially collapsed position. The frame 1 is comprised of two parallelogram shaped assemblies which are inner frame assembly 21 and outer frame assembly 22, joined by two telescoping support assemblies 23 and pivot bolt assembly 14. Inner frame assembly 21 is made shorter in width than outer frame assembly 22, so that the inner frame can pass freely inside the outer frame, otherwise the two frame assemblies 21 and 22 are identical in construction and size. The horizontal members of each frame asssembly 21 and 22, which are formed by the cross braces 8 are made to be sufficiently long in length in order to properly support a sailboard or surfboard without tipping on end. Inner frame assembly 21 comprises two end braces 7, two horizontal member each comprising two cross braces 8 and a first tee section 12, four corner elbows 10, and two pivot rods 11. The end braces 7 and cross braces 8 are preferably made from plastic 'PVC' tubing, although aluminum or other lightweight tubing material may be used, providing that it has adequate strength. The four corner elbows are similarly, of plastic 'PVC' material or aluminum. The pivot rods 11 are both preferably of aluminum tubing. End braces 7, cross braces 8 and the corner elbows 10 are joined by gluding and by a press fit. A first hole 24 is located drilled through the center of end brace 7 to accommodate pivot bolt assembly 14 which fastens the inner frame assembly to the outer frame assembly. Pivot rod 11 is inserted in cross braces 8 at both the top and bottom of the inner frame assembly 21. Rivet holes 26 are located in both the pivot rods 11 and cross braces 8, so that they match location when the pivot rods 11 are centered in the frame as shown in FIG. 3. The pivot rods 11 are not fastened to cross braces 8 until after the telescoping support assemblies 23 are attached in position. Stand 2 is fastened in position by pivot bolt assembly 14.

Outer frame assembly 22 comprises two end braces 7, two horizontal members each comprising two cross braces 9 and a second tee section 13, four corner elbows 10, and two pivot rods 11. Except for the lengths of cross braces 9, which are longer than the equivalent cross braces 8 in inner frame assembly 21, all components of outer frame assembly 22 are identical to those of inner frame assembly 21. A second hole 25 is drilled through the center of end brace 7 to accommodate pivot bolt assembly 14.

Referring to FIG. 4, a carrying bag 16 is shown in dashed lines, hanging from the top of inner and outer frame assemblies 21 and 22. The carrying bag may be made of canvas or any suitable lightweight material, and can be fastened to the top cross braces 8 by straps or other suitable means such as 'VELCRO' pads. Carrying bag 16 could be left attached to the frame, when the device is collapsed for storage, if that is desired.

Referring again to FIGS. 3 and 4, the two telescoping support assemblies 23 are depicted attached to the inner and outer frame assemblies 21 and 22. In this configuration, each telescoping support assembly 23 is pivatally attached to the top of one frame assembly and to the bottom of the other frame assembly. That is, between the top of inner frame assembly 21 and the bottom of outer frame assembly 22, and also between the top of outer frame assembly 22 and the bottom of inner frame assembly 21. Thus, the telescoping support assemblies 23 provide connection and support to inner and outer frame assemblies 21 and 22. Each telescoping support assembly 23 comprises a tube holder 5, a slide rod 6, a first tee section 12 and a second tee section 13. The tee sections 12 and 13 and tube holder 5 are preferably of plastic 'PVC' tubing while slide rod 6 is preferably made of aluminum tubing. First tee section 12 is identical to second tee section 13 except that a wheel axle hole 15 is located in second tee section 13, drilled along an axis rotated 90 degrees from the longitudinal 'bar' axis of the tee. Tube holder 5 is inserted in and attached to first tee section 12, and slide rod 6 is inserted in second tee section 13. A wheel axle hole 15 is located near the end of slide rod 6, so that it matches the wheel axle hole 15 in second tee section 13.

Figure 5:
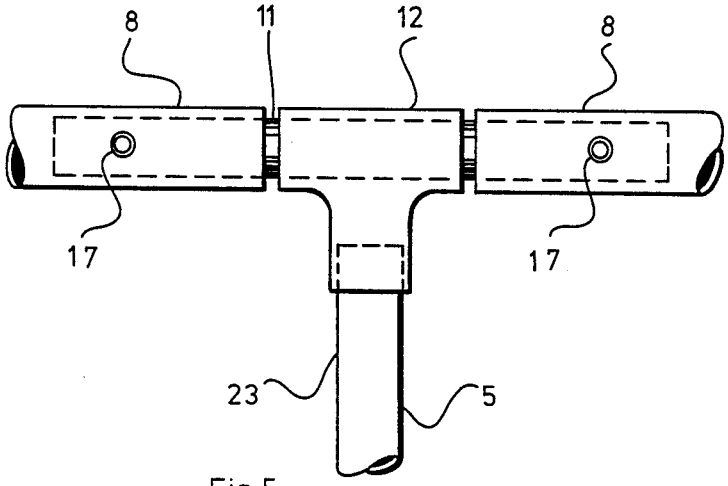
FIG. 5 is a detail drawing showing the attachment of the telescoping support assembly to the frame and provision for rotation of the telescoping support assembly with respect to the frame.

Referring now, to FIG. 5, as an aid to understanding, there is depicted a detail showing how the telescoping support assembly 23 is attached to the frame assemblies 21 and 22. In this illustration, the exaaple shown is for the top of inner frame assembly 21 and the top of telescoping support assembly 23. However, the attachment approach is identical for the top and bottom connections of each telescoping support assembly 23 to each frame assembly. For proper operation of the device, it is necessary for the ends of the telescoping support assembly 23 to be able to rotate with respect to the frame assemblies. This is achieved by passing the pivot rod 11 through the tee section 12 of telescoping support assembly 23, through cross braces 8, and fastening the pivot rod 11 rigidly by rivet connections 17, to cross braces 8. When this is done, the action of causing slide rod 6, to slide with respect to tube holder 5, will result in the rotation of first tee section 12 around the fixed pivot rod 11. Similarly, second tee section 13 will rotate around fixed pivot rod 11 in the bottom of the frame. When the inner and outer frame assemblies are fully opened, tube holder 5 slides down over slide rod 6 and bottoms against second tee section 13, making the frame 1 rigid for support of a sailboard 4.

Figure 6:
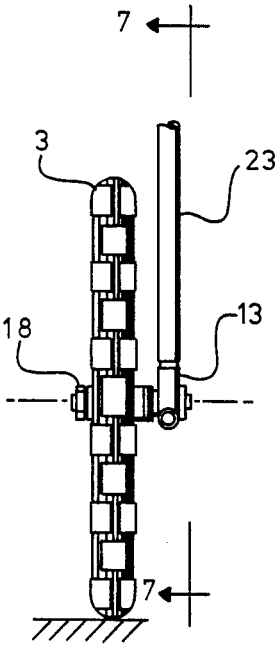
FIG. 6 is a side elevation view of the wheel assembly attached to the frame, showing the frame in partial view.
Figure 7:
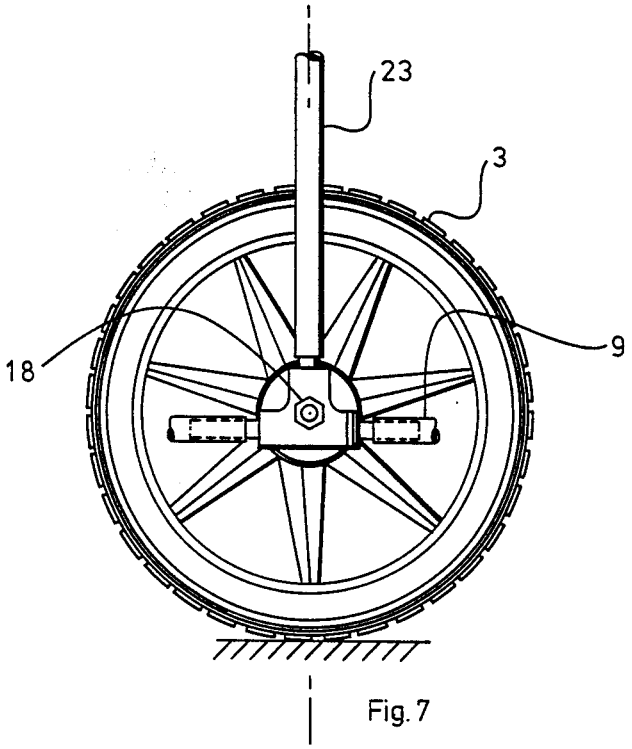
FIG. 7 is a front elevation view of the wheel assembly attached to the frame, showing a partial view of the frame taken along line 7—7 of FIG. 6.

The support arrangement for the wheel is depicted in FIG. 6 and FIG. 7. Wheel axle bolt 18 is made of steel and is passed through wheel axle hole 15 in second tee section 13, which is part of telescoping support assembly 23. The wheel axle is thus at 90 degrees to the telescoping support assembly 23, requiring that the wheel 3 remains parallel to the telescoping support assembly 23 at all times, whether the device is fully open or is collapsed for storage. The length of wheel axle bolt 18 is short, so that cantilever shear stress on the axle and hub of wheel 3 is moderate. The tires used on the wheels 3 are preferably 'balloon' type pneumatic tires, large enough to prevent the device from sinking in the soft sand, when being wheeled across a sandy beach on the way to delivering the sailboard or surfboard to the water's edge.

It is believed that the device described above as the preferred embodiment, achieves the objectives of the present invention. Alternative embodiments and various modifications of the embodiments depicted will be apparent to those skilled in the art. These and other alternatives are considered to be equivalent and within the spirit and scope of the present invention.

Having described the invention, what is claimed is:

1. A sailboard dolly comprising a frame, a stand and two wheel assemblies: said frame being collapsible in a scissors-like fashion forming a relatively flat package; said wheel assemblies being independently mounted on either side of said frame; said frame being made of light weight tubing: said frame shape, size and construction being such that a sailboard may be transported supported near its edges in a manner to minimize possible damage to the board surface, while the dolly wheelbase and length of the horizontal members provide stability and avoid tipping; said stand being for preventing the sailboard dolly from tipping on end when the dolly is stationary said frame comprising an inner frame assembly, an outer frame assembly, two telescoping support assemblies, and two pivot bolt assemblies; said telescoping support assemblies being pivotally fastened at one end to said inner frame assembly, and pivotally fastened at the other end to said outer frame assembly, so that when said frame is opened fully, said telescoping assemblies hold said inner and outer frame assemblies in a rigid frame structure capable of supporting a sailboard; said inner frame assembly and said outer frame assembly being identically shaped and sized parallelogram assemblies, except that said inner frame assembly is shorter in width so that it can rotate freely at a fixed point inside said outer frame assembly; said rotation point being determined by said two pivot bolt assemblies said bolt assemblies fastening said inner frane assembly to said outer frame assembly; said inner and outer frame each comprising two end braces; two horizontal members each comprising two cross braces and a first and second tee section, four corner elbows and two pivot rods, said inner and outer frame assembly components being joined by gluing and a press fit; said end braces each having a hole drilled through at the center point of its length to accomodate said pivot bolt assemblies; said pivot rods having a smaller diameter than the inside diameter of said cross braces, and having two holes drilled in them to accomodate a rivet; said cross braces each having a hole drilled through them to match the position of the rivet holes in said pivot rods, which are located inside said cross braces; said stand being fastened to said frame by one of said pivot bolt assemblies, allowing said stand to be rotated when necessary; said inner and outer frame assemblies being pivotally fastened to each other by said pivot bolt assemblies and also by said telescoping support assemblies, so that said frame can open fully in an 'X' shape, or close flat in scissors-like fashion.

2. A sailboard dolly comprising a frame, a stand and two wheel assemblies; said frame being collapsible in a scissors-like fashion forming a relatively flat package; said wheel assemblies being independently mounted on either side of said frame; said frame being made of light weight tubing; said frame shape, size and construction being such that a sailboard or surfboard may be transported supported near its edges in a manner to minimize possible damage to the board surface, while the dolly wheelbase and length of the horizontal members provide stability and avoid tipping; said stand being for preventing the sailboard dolly from tipping on end when the dolly is stationary; said frame comprising an inner frame assembly, an outer frame assembly, two telescoping support assemblies, and two pivot bolt assemblies; said telescoping support assemblies being pivotally fastened at one end to said inner frame assembly, and pivotally fastened at the other end to said outer frame assembly, so that when said frame is opened fully, said telescoping assemblies hold said inner and outer frame assemblies in a rigid frame structure capable of supporting a sailboard; said telescoping support assembly comprising a tube holder, a slide rod, a first tee section and a second tee section; said tee sections each being pivotally fastened to said inner and outer frame assemblies; said tube holder and tee sections being made from a light weight tubing and said slide rod being made from aluminum tubing; said slide rod being sized in diameter to be able to slide through the inside diameter of said tube holder along its length; said tube holder being attached to said first tee section, and said slide rod being attached to said second tee section; said second tee section having a wheel axle hole located and drilled through it along an axis rotated 90 degrees from the longitudinal 'bar' axis of the tee, and said slide rod having a matching wheel axle hole drilled through it; said telescoping support being pivotally attahced to said inner and outer frame assemblies by passing aluminum pivot rods through the longitudinal 'bar' axis of said tee sections and fastening said pivot rods to said cross braces by rivet fasteners, the tee sections of said telescoping support assembly thus being allowed to rotate around the fixed pivot rods as said telescoping support assembly slides open and closed.

* * * * *